US005335052A

United States Patent [19]

Sato et al.

[11] Patent Number: 5,335,052

[45] Date of Patent: Aug. 2, 1994

[54] IMAGE RECORDING APPARATUS WITH BELT-TYPE TRANSFER DEVICE

[75] Inventors: Kenji Sato; Naoto Tokutake, both of Hachioji, Japan

[73] Assignee: Konica Corporation, Tokyo, Japan

[21] Appl. No.: 86,611

[22] Filed: Jul. 2, 1993

[30] Foreign Application Priority Data

Aug. 7, 1992 [JP] Japan ..... 4-211438

[51] Int. Cl.[5] ..... G03G 15/16

[52] U.S. Cl. ..... 355/271; 355/274

[58] Field of Search ..... 355/275, 271, 273, 274, 355/276, 280–281, 277, 272, 212, 210, 203; 346/153.1, 150

[56] References Cited

U.S. PATENT DOCUMENTS

| | | | |
|---|---|---|---|
| 5,051,783 | 9/1991 | Sato | 355/271 |
| 5,115,280 | 5/1992 | Hamada et al. | 355/299 |
| 5,140,375 | 8/1992 | Shindo et al. | 355/272 |
| 5,172,174 | 12/1992 | Fuma et al. | 355/275 |
| 5,196,870 | 3/1993 | Itoh et al. | 346/155 |
| 5,216,453 | 6/1993 | Itoh | 346/153.1 |

*Primary Examiner*—A. T. Grimley
*Assistant Examiner*—T. A. Dang
*Attorney, Agent, or Firm*—Frishauf, Holtz, Goodman & Woodward

[57] ABSTRACT

An image forming apparatus includes a transfer belt device which transfers a toner image formed on a rotating photosensitive drum onto a recording sheet by providing corona charging from a rear surface of a transferring/conveying belt that is stretched around a driving roller and a driven roller, which conveys the recording sheet. A movable frame supports both ends of the rotational shafts of the driving roller and the driven roller. The movable frame is rotatably supported by a stationary housing of the transfer belt device. The movable frame can oscillate around a bearing section so that both ends of the rotational shaft of the driving roller connected with a driving source are supported. One end of the shaft of the driving roller connected with the driving source is supported by a stationary bearing member of the stationary housing. The other end of the shaft of the driving roller is supported by a movable bearing member which is movably provided in the stationary housing.

6 Claims, 10 Drawing Sheets

IMAGE RECORDING APPARATUS WITH BELT-TYPE TRANSFER DEVICE

BACKGROUND OF THE INVENTION

The present invention relates to an image recording apparatus such as an electrophotographic copier or printer, and especially to an image recording apparatus in which: a toner image is obtained by developing a latent image on a photoreceptor; the toner image is physically transferred onto a recording sheet by a transferring/conveying belt device having a rotating transferring/conveying belt; and after that the recording sheet, to which the toner image has been adhered, is conveyed to a fixing means for fixing the toner image on the recording sheet.

In the image recording apparatus such as an electrophotographic copier or printer, for example, the peripheral surface of a photosensitive drum, is uniformly charged by a charger, the peripheral surface of the photosensitive drum is exposed, and an electrostatic latent image is formed thereon. The latent image is developed into a toner image by a developing means. The toner image formed on the peripheral surface of the photosensitive drum is transferred onto the recording sheet, which is conveyed in timed relation with the photosensitive drum, by a physical means. The recording sheet, onto which the toner image has been transferred, is separated from the photosensitive drum, conveyed to a fixing means, and delivered to the outside of the apparatus after the toner image has been fixed onto the recording sheet.

The transfer means, by which the toner image is adhered to the peripheral surface of the photosensitive drum an transferred onto a recording sheet, functions as follows: charging, the polarity of which is negative with respect to the charging polarity of the toner, is carried out so that the toner image is transferred onto the recording sheet by a transfer device by which charging is conducted from the back of the recording sheet; and after transfer, an AC high voltage is impressed upon the recording sheet so that the recording sheet is discharged and separated from the photosensitive drum. However, it is difficult to positively maintain transfer properties and separability. Especially, when the diameter of the photosensitive drum is large, it is difficult to separate the recording sheet from the drum. In this case, the recording sheet, onto which the toner image has been transferred, is stuck to the photosensitive drum, and this is apt to cause paper jamming, which is disadvantageous. A transferring belt device is used to overcome the above disadvantage.

The transferring belt device is structured in the manner that the transferring/conveying belt is stretched around a plurality of rollers, and is rotated at the same speed as that of the photosensitive drum. In the transferring belt device, a charge supplying means is provided by which the recording sheet is electrostatically stuck to the transferring/conveying belt. The recording sheet is contacted with the photosensitive drum in the transfer section, while the recording sheet is stuck to the transferring/conveying belt. A high voltage, the polarity of which is reverse to that of the toner charging polarity, is impressed upon the transfer section using a constant current control so that the toner image is transferred. Superior transfer efficiencies and separation effects can be obtained in the transfer section of the transferring belt device.

If the transferring belt device is desirably used in a color image recording device in which toner images are superimposed on the photosensitive drum and transferred onto the recording sheet at one time, then in the image recording apparatus, it is necessary to provide a plurality of developing devices around the peripheral surface of the photoreceptor drum because toner images are superimposed on the photoreceptor, resulting in a large drum diameter. Therefore, sufficient sheet separation properties can not be obtained in the conventional electrostatic transfer separation method. Accordingly, more positive separation properties are necessary. In a method in which toner images are superimposed, a toner adhesion amount is large, and therefore, a large electric charge amount is necessary. Accordingly, a large transfer electric charge holding ability is necessary. Such a transferring belt device is superior in the foregoing two points.

However, in the image recording apparatus having a transferring belt device as shown in FIG. 1, when a corona discharger 36 is provided on the rear surface of the transferring belt 31 and corona discharging is conducted at a nip section N, at which a transferring/conveying belt 31 is stretched around a drive roller 32 and a driven roller 33 is contacted with a photosensitive drum 10, and transferring is conducted on a recording sheet P conveyed by the transferring/conveying belt 31, there are possibilities that sufficient transfer properties can not be obtained at the time of low humidity, and partial transfer due to carrier adhesion occurs.

Further, in the transferring device in which the rotational shafts of the driving roller 32, driven roller 33 or a tension roller 35 are not positioned accurately in parallel with each other in a frame body, the accuracy of an interval between the photosensitive drum 10 and the transferring/conveying belt is lowered at the nip section and thereby, inferior transfer occurs, or loads are unevenly provided on the transferring/conveying belt 31, so that the belt is skewed. However, when rollers 32, 33 and 35 are assembled in mass production, it is very difficult to provide them accurately in parallel with each other in the frame.

The inventors of the present invention have investigated causes of the foregoing unstable transfer properties, and found that the condition under which the transferring/conveying belt 31 is contacted with the photosensitive drum 10 is unstable. In order to solve the foregoing problems, as shown in FIG. 1, a spacing roller 39 is provided inside the transferring/conveying belt 31 at the upstream side of the nip section N at which the photosensitive drum 10 is contacted with the transferring belt 31 so that the transferring/conveying belt 31 is pressed to the photosensitive drum 10 by the spacing roller 39. As a result of the foregoing structure, the transferring/conveying belt 31 can keep the contacting condition with the photosensitive drum 10 within a wide range from the position of the spacing roller to the nip section, so that the foregoing inferior transfer does not occur.

However, several problems are not solved by the foregoing method. As will be explained later, the transfer/conveying belt is separated from the photosensitive drum 10 during the image formation, and the transferring belt 31 is contacted with the photosensitive drum 10 with pressure only when transferring. At that time, the pressing force works most strongly on the roller 39 which is newly provided, and therefore, it is necessary for the pressing force to be adjusted within an appropriate range. When the value of the pressing force is beyond the above-described range, an inferior transfer phenomenon, which is called transfer repelling, is caused, so that transfer properties are greatly lowered.

A skewed pressing force of the transferring/conveying belt 31 on the photosensitive drum 10 is caused when a stationary bearing section of the driving roller 32, which is the center of oscillation of a movable section of the transferring belt device, is not exactly in parallel with that of the spacing roller 39. In order to accurately provide parallel alignment, it is necessary to increase the machining accuracy, to add assembling and adjusting members, or to provide complicated adjusting processes. Further, according to the environmental conditions of temperature and humidity, the transferring/conveying belt expands and contracts, and therefore, uniform transfer properties can not be obtained.

Further, the present invention relates to the control of operations of a cleaning device by which an image carrier for image formation in a printer in the image forming apparatus or a copying apparatus is cleaned.

In conventional image formation, the surface of an image forming body which is formed by the photosensitive drum is charged; latent images are written on the surface; a plurality of color toner developers are developed a plurality of times (four times); finally, the developing surface is exposed; a color toner image is transferred onto the recording sheet by a belt type transfer means; and after that, the surface of the image forming body is cleaned by the cleaning blade.

In the conventional printer or copying apparatus as described above, the surface of a drum-shaped image forming body is cleaned by a blade type cleaning member after transfer has been completed. In this case, no toner remains on the image forming surface which has been cleaned by the blade type cleaning member, so that an excellent cleaning condition can be provided. However, a slight amount of color toner remains on an end of the cleaning blade. Especially, in a full color image forming apparatus in which it is necessary for the cleaning blade to be contacted with and released from the image forming surface, a ridge of toner remains on the image forming surface when the cleaning blade is removed from the image forming surface.

When cleaning is conducted only on the image forming surface on which the color toner image is formed, and from which the image is transferred, a release position of the cleaning blade is changed a little, and there occur many color toner remaining portions on the image forming surface. These remaining color toners enter into the developing device, adhere to the transferring belt, and adhere to the rear side of the recording sheet and stain it, which are problems.

SUMMARY OF THE INVENTION

The first object of the present invention is to provide an image recording apparatus with a transferring belt device in which unstable transfer is never conducted, and therefore, superior transfer properties can be always secured.

The second object of the present invention is, at least, to prevent the occurrence of ridges of toner, in which many color toners are mixed, on the image forming surface.

The first embodiment to accomplish the foregoing objects is structured as follows: in an image recording apparatus with a transferring belt device by which a toner image formed on a rotating photosensitive drum is transferred onto a recording sheet by corona charging conducted from the side of the rear surface of a transferring/conveying belt stretched around a driving roller and a driven roller, by which the recording sheet is conveyed, a movable frame, by which both ends of the rotational shafts of the driving roller and the driven roller are supported, is rotatably supported by a stationary housing of the transferring belt device, wherein the movable frame can oscillate around a bearing section by which both ends of the rotational shaft of the driving roller connected with a driving source are supported; one end of the shaft of the driving roller connected with the driving source is supported by a stationary bearing member of the stationary housing; and the other end of the shaft of the driving roller is supported by a movable bearing member which is movably provided in the stationary housing.

The second embodiment of the present invention is structured as follows: a spacing roller, which has large diameter portions at both ends of its shaft, which are contacted with the photosensitive drum during transfer so that the transferring/conveying belt can be positioned, is provided inside the transferring belt upstream of a contact position of the photosensitive drum with the transferring/conveying belt; one end of the shaft of the driving roller connected with the driving source is supported by a stationary bearing member of the stationary housing; and the other end of the shaft of the driving roller is supported by a movable bearing member which is movably provided in the stationary housing.

In order to accomplish the above objects, the third embodiment of the present invention is to provide an image forming apparatus comprising: an image forming means that includes an image forming drum, a charging electrode provided around a periphery of the image forming drum to give an electric charge onto the surface of the image forming drum, a latent image writing means that forms a latent image, a plurality of developing means, and a cleaning means; and a belt type transfer means that transfers an image formed by the image forming means onto a recording sheet from the drum surface, wherein a toner image is formed on the image forming drum by the image forming means, the formed toner image is transferred onto the recording sheet by the belt type transfer means, and when the image forming drum surface is cleaned by the blade-shaped cleaning means contacted with and released from the drum surface, a region in which the blade-shaped cleaning means is in press contact with the drum surface includes a toner remaining region where toner has been left after the image transfer operation, and also includes a toner remaining region where toner has been left after the cleaning means has been released from the drum surface in the previous image forming operation.

DETAILED DESCRIPTION OF THE PREFERRED EMBODIMENTS

Figure 1:
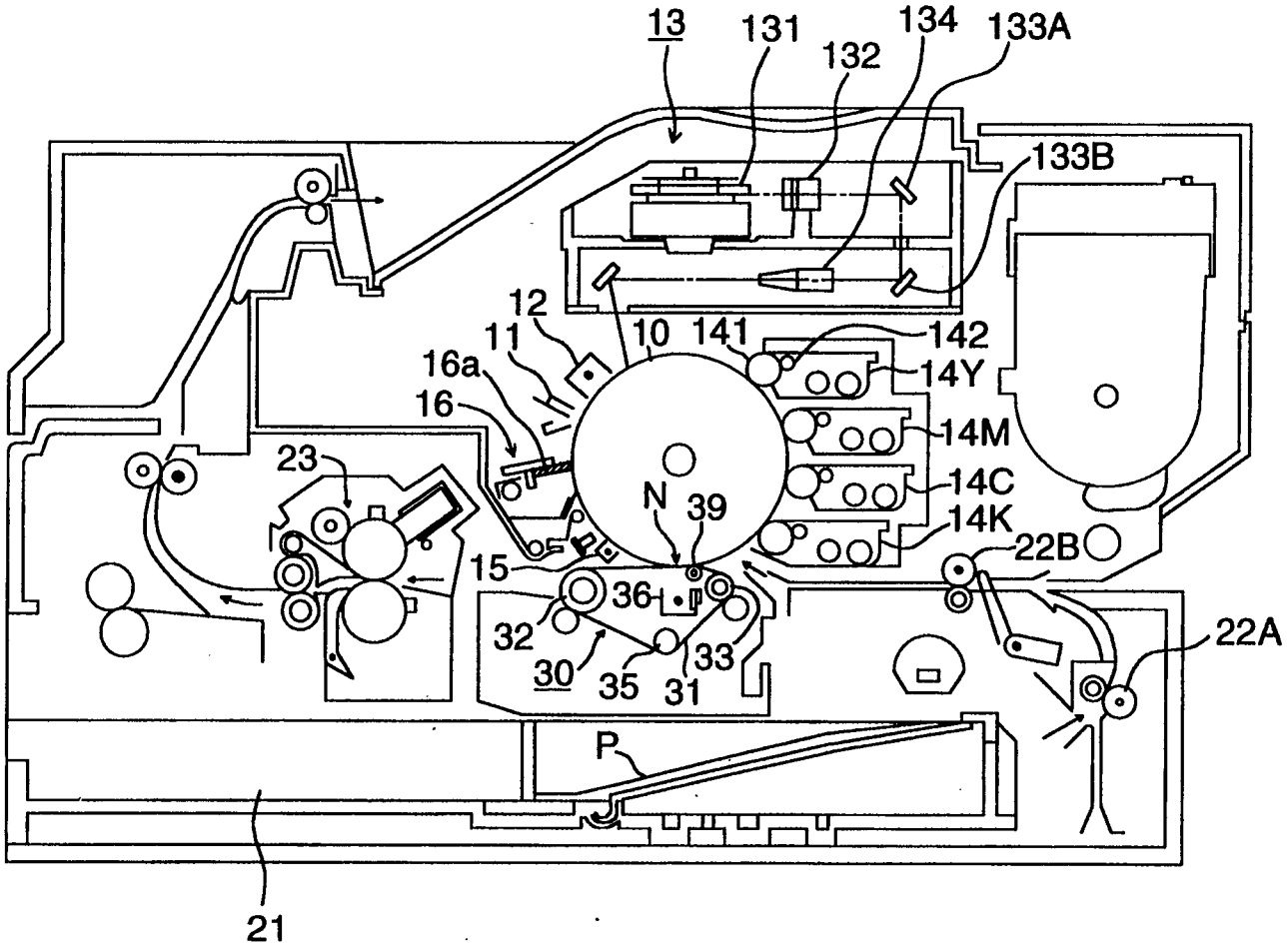
FIG. 1 is a view of the entire structure showing an embodiment of an image recording apparatus of the present invention.

FIG. 1 is a view showing the entire structure of a color image recording apparatus (a color printer) as an example of an image recording apparatus according to the present invention. The entire structure and operations of the apparatus will be described as follows.

In FIG. 1, numeral 10 is a photosensitive drum which is an image carrier. It is grounded by means of coating an OPC photosensitive layer on the drum, and rotated clockwise. Numeral 12 is a scorotron charger by which the peripheral surface of the photosensitive drum 10 is uniformly charged with an electric potential of $V_H$ (−600 to −800 V) by a corona discharge using a grid, potential of which is maintained at $V_G$ (−550 to −850 V), and a corona discharge wire. Prior to charging by the scorotron charger 12, the peripheral surface of the photosensitive drum is discharged when exposure is conducted by a pre-charging exposing means (PCL) 11 using a light emitting diode in order to eliminate any trace of the preceding printing operation on the photosensitive drum.

After the photosensitive drum has been uniformly charged, imagewise exposure according to an image signal is conducted by an imagewise exposure means 13. A laser beam, the light source of which is a laser diode not shown in the drawings, passes through a rotating polygonal mirror 131 and a collimator lens 132, and its light path is deflected by reflection mirrors 133A and 133B. After that, the laser beam passes through an fθ lens and thereby, scanning is conducted. A latent image is formed by a rotation of the photosensitive drum 10 (subsidiary scanning). In the example, exposure is conducted on a character section, and a reversal latent image is formed in which the character section becomes a low potential $V_L$ (−100 V to 0).

Developing devices 14Y, 14M, 14C, and 14K, in which developers composed of yellow (Y), magenta (M), cyan (C), Black (K) toners and carrier are accommodated respectively, are provided around the photosensitive drum 10. At first, the first color development is conducted by a developing sleeve 141 in which a magnet is accommodated, and which is rotated while holding the developer therewith. The developer is composed of: a carrier in which ferrite is used as a core, and insulating resin is coated around the core; and a toner in which polyester is used as the main material, and a pigment according to the color, a charge control agent, silica, and titanium oxide are added to the main material. A layer thickness of the developer is regulated to 300 to 600 μm on the developing sleeve 141 by a layer forming bar 142, and the developer is conveyed to a developing area.

A gap between the developing sleeve 141 and the photosensitive drum 10 in the developing area is 0.4 to 1.0 mm which is larger than the layer thickness of the developer. An AC bias voltage of $V_{AC}$ (1.5 to 3.0 $kV_{P-P}$) and a DC bias voltage of $V_{DC}$ (−500 to −700 V) are superimposed and impressed upon the gap. $V_{DC}$, $V_H$, and toner charging potential have the same polarity, and therefore, the toner which is given an opportunity to separate from the carrier, does not adhere to a $V_H$ portion having higher potential than $V_{DC}$, but adheres to a $V_L$ portion having lower potential than $V_{DC}$, and visualizing (reversal development) is carried out.

After the first color visualizing has been completed, the image forming operation enters into the second color image forming process, the image forming surface is uniformly charged again by the scorotron charger 12, and a latent image according to the second color image data is formed by an imagewise exposure means 13. Charge elimination which has been conducted in the first color image forming process by the pre-charging exposure means 11, is not carried out this time because the toner adhered to the first color image portion splashes when the potential surrounding the image portion is suddenly changed.

In a photoreceptor having again a potential of $V_H$ covering the entire peripheral surface of the photosensitive drum 10, the latent image is formed in the same way as that of the first color, and developed on a portion on which the first color image does not exist. When development is conducted again on a portion on which the first color image exists, a latent image having a potential of $V_M'$ is formed by light insulation by the toner adhered to the first color image portion and the electric charge of the toner itself, and developed corresponding to the potential difference between $V_D$ and $V_M'$. When the first color development is conducted on the latent image having a potential of $V_L$ on a portion on which the second color image is superimposed on the first color image, balance between the first color image and the second color image is lost. Therefore, sometimes, the first color exposure amount is decreased to the amount corresponding to an intermediate potential which is obtained by the following formula.

$$V_H > V_M(-100 \text{ to } -300) > V_L$$

The same image forming processes as that of the second color image are conducted on the third color and the fourth color images, and the four color visual image is formed on the peripheral surface of the photosensitive drum 10.

A recording sheet P having been conveyed from a sheet feeding cassette 21 by a sheet feed mechanism 22A and 22B is fed to a transferring area by a transferring belt device 30 composed of a stretched transferring-/conveying belt 31 (called transferring belt, hereinafter), which will be described later, and a multi-color image on the peripheral surface of the photosensitive drum is collectively transferred onto the recording sheet P.

The transferring belt 31 is an endless rubber belt, the thickness of which is 0.4 to 1.0 mm, and which is made by forming an FLC layer outside a polyurethane rubber body and has resistance of $10^6$ to $10^{14}$ Ω·cm, and sometimes a rib is provided on its end portion to prevent belt skew during rotation. The transferring belt 31 may have a film such as polyethylene telephtalate (PET), or a high resistance belt on which polyethylene telephtalate or the like is coated.

A voltage $V_{PC}$ (1.0 to 3.0 kV) is impressed upon a rotation shaft 33a of a driven roller 33 which is provided in the upstream side of a driving roller 32 and the driven roller 33 around which the transferring belt 31 is stretched. A conductive brush 34 is grounded to the rotation shaft 33a through the transferring belt 31, or a non-linear element or a resistor as a charge applying means to the recording sheet P. The conveyed recording sheet P enters between the brush 34 and the transferring belt 31, an electric charge is given from the brush 34 to the recording sheet P, and thereby, the attractive force is generated between the recording sheet P and the transferring belt 31. After that, the recording sheet P enters a nip portion (transferring area) N which is formed by the photosensitive drum 10 and the transferring belt 31, a transferring electric field is given to the recording sheet P by a corona discharger 36 or a bias roller, instead of the discharger, from the rear surface of the transferring belt 31, and the multi-color image is transferred onto the recording sheet P. In order to positively conduct pressure contact and transfer at the nip portion, a spacing roller 39 is provided close to the upstream side of the nip portion. Numeral 35 is a tension roller.

The recording sheet P separated from the photosensitive drum 10 is discharged by the AC corona discharger using a shaft 32a of the driving roller 32, around which the transferring belt 31 is stretched, as an opposing electrode, wherein the driving roller 32 is provided in the downstream side of the driven roller. After that, or while being discharged by the AC corona discharger, the recording sheet P is separated from the transferring belt 31. Toner adhered to the transferring belt 31 is cleaned by a cleaning means using a cleaning roller, which will be described later referring to FIG. 2 and FIG. 3.

The recording sheet P which holds the multi-color image thereon and is separated from the transferring belt device 30, is conveyed to a fixing device 23 which is composed of two pressing rollers, wherein a heater is accommodated inside at least one roller. The toner adhered to the recording sheet P is fused when the recording sheet is heated and pressed between two pressing rollers, and is fixed onto the recording sheet P. After that, the sheet is delivered to the outside of the apparatus.

On the other hand, toner remaining on the peripheral surface of the photosensitive drum 10 after transfer, is discharged by a discharger 15 using the AC corona discharger, and after that, conveyed to a cleaning device 16. The toner is scraped down into the cleaning device 16 by a cleaning blade 16a, which is made of rubber and contacted with the photoreceptor, delivered by a screw, and after that, the toner is collected into a collection box. Here, the discharger 15 can be positioned as shown in FIG. 1, and the recording sheet P can be discharged by it at the same time as the toner on the peripheral surface of the photosensitive drum.

After the photosensitive drum 10, from which the remaining toner is removed by the cleaning device 16, is exposed by the pre-charging exposure means 11, it is uniformly charged by the scorotron charger 12, and enters the next image forming cycle. The cleaning blade 16a is separated from the photoreceptor surface during the multi-color image formation, and the AC discharge by the discharger 15 is turned OFF.

Figure 2:
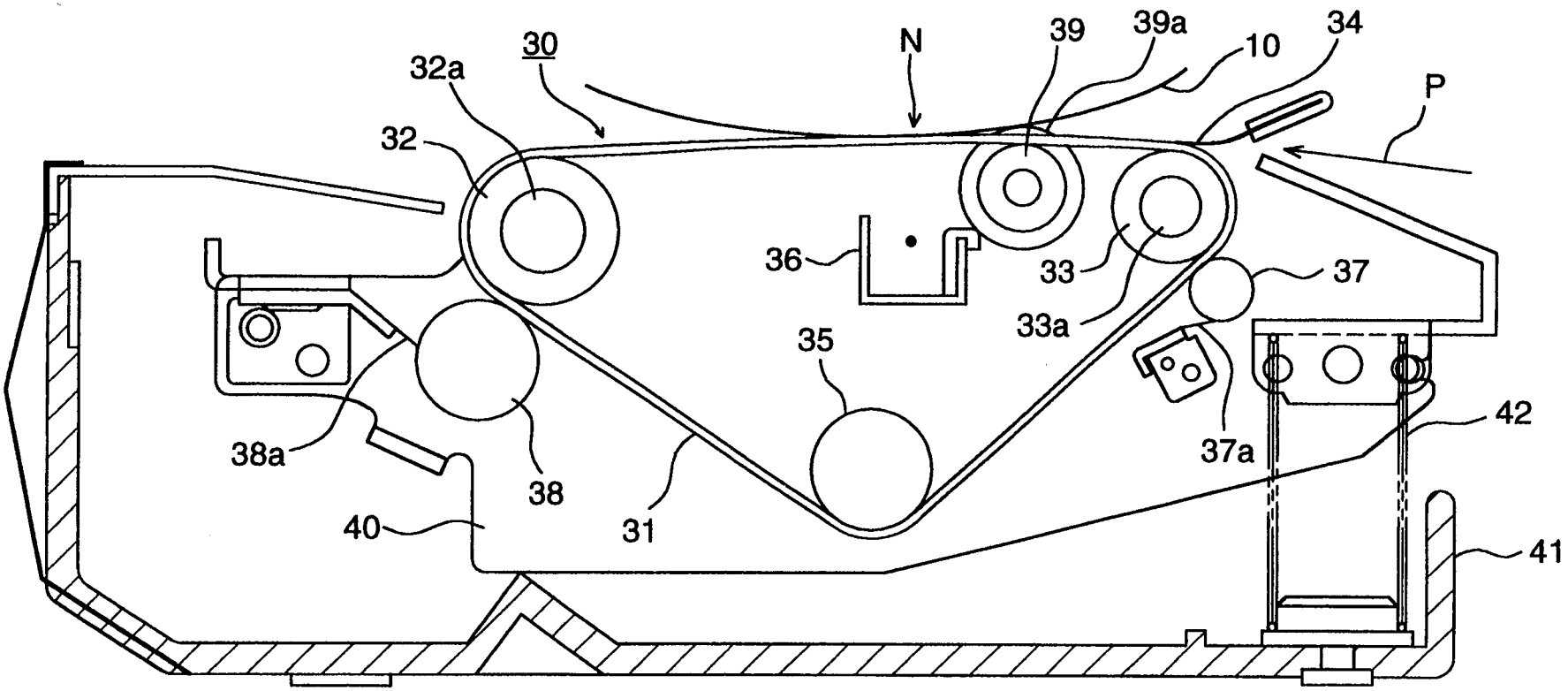
FIG. 2 is a schematic view showing the structure of a transferring belt device of the present invention.

FIG. 2 is a schematic view showing an example of the present invention, in which the transferring belt device 31 of the image recording apparatus shown in FIG. 1 is enlarged. The transferring belt device 30 is composed of the driving roller 32, driven roller 33, tension roller 35, spacing roller 39, and a transferring electrode 36 inside the transferring belt 31, and these are provided in and held by the movable frame 40. The movable frame 40 can oscillate with respect to a stationary housing 41 by which the rotation shaft 32a of the driving roller 32 is supported, and is urged upward by a pressing spring 42 held by the other end of the stationary housing 41. A flange portion 39a of the rotatable spacing roller 39 is contacted with a non-image forming area at both ends of the photosensitive drum 10, and the peripheral surface of the photosensitive drum 10 and the transferring belt 31 form a predetermined nip portion.

When the transferring operation is not conducted, the movable frame 40 is oscillated downward around the rotation shaft 32a by a driving means which is not shown in the drawings, and separated from the nip portion N of the photosensitive drum 10.

Figure 3:
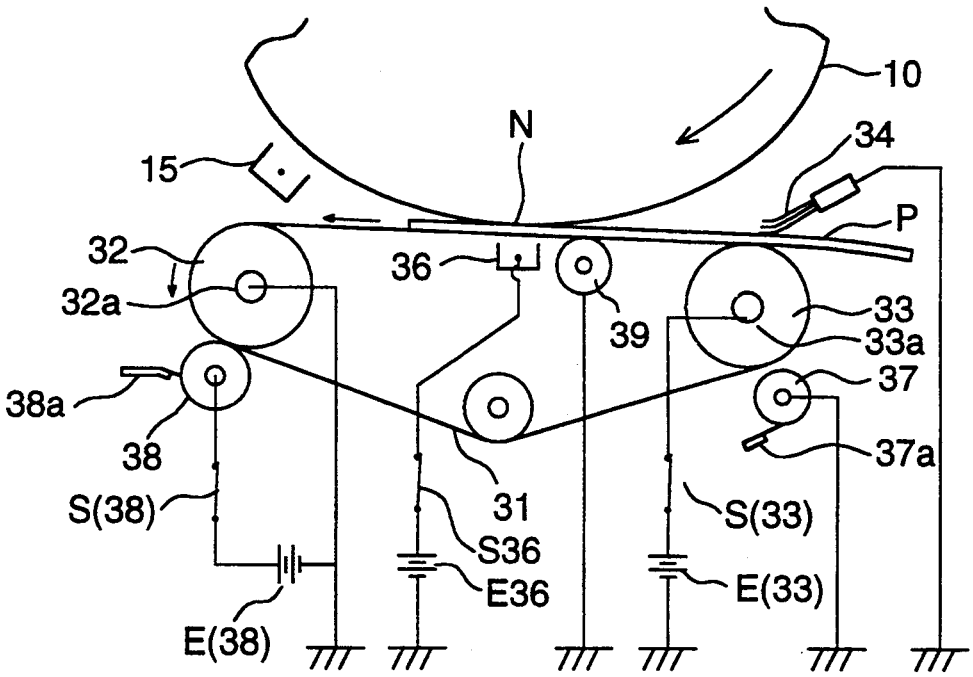
FIG. 3 is an illustration of a transfer operation being conducted by the transferring belt device.
Figure 4:
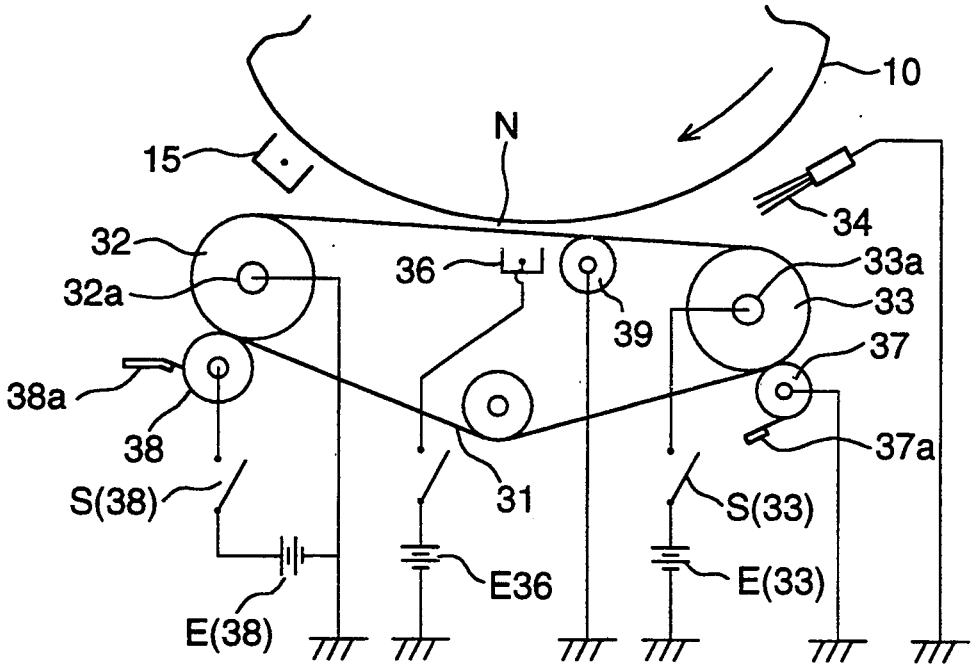
FIG. 4 is an illustration of the transferring belt separated from a photosensitive drum.

FIG. 3 shows the transferring belt device 30 at the time of the transferring operation in which the transferring belt 31 is contacted with the photosensitive drum 10 through the recording sheet P, and FIG. 4 shows the condition in which the transferring belt 31 is separated from the photosensitive drum 10.

The drive roller 32 is contacted with a rotatable metallic conductive cleaning roller 38 through the transferring belt 31, and the driven roller 33 positioned in the back portion of the forward direction of the transferring belt 31 by which the transferring operation has been completed, is contacted with a rotatable metallic conductive cleaning roller 37 through the transferring belt 31.

The driving roller 32 is grounded, and a positive bias potential is impressed upon the cleaning roller 38, which is opposed to the driving roller 32, by a power source for cleaning E(38). The transferring belt 31 is cleaned as follows: a positive corona discharge is conducted by the transferring electrode 36 when transferring; toner which is moved from the photosensitive drum and adhered to the transferring belt 31 at the time of the transferring operation or before or after the operation, is negatively charged by a separation discharge when the transfer sheet is separated from the transferring belt; and therefore, when the toner adhered to the transferring belt 31 is contacted with the cleaning roller 38, and passes through the roller, the toner adheres and transfers to the cleaning roller 38, upon which a positive bias voltage is impressed, and which is idly rotated by the driving roller, so that the transferring belt 31 is cleaned. The toner which has adhered and transferred to the cleaning roller 38, is scraped off by an elastic cleaning blade 38a which is made of PET or rubber, and which is slidingly contacted with the rotating cleaning roller 38. A switch S(38) is provided between the cleaning roller, upon which a positive bias voltage is impressed, and the power source E(38). The switch S(38) is turned ON, for example, linked with the operation of the transferring belt, and turned ON only during rotation of the transferring belt, or turned ON and OFF in timed relation with a switch S(36) provided to a recording sheet charging power source E(36) shown in FIG. 3 and FIG. 4.

The cleaning means of the example is structured as follows: toner which does not adhere and transfer to the cleaning roller 38, and remains adhered to the transferring belt 31 when the toner has contacted and passed the cleaning roller 38 is cleaned by a cleaning roller 37 having a reverse (negative) bias which is downstream of the cleaning roller 38 having a positive charge by a sheet separation.

Cleaning operations are carried out as follows. A recording sheet charging power source E(33) is connected with the driven roller 33 through a switch S(33) so that the roller has a positive potential; the cleaning roller 37 which is contacted with the driven roller 33 with pressure through the transferring belt 31, and idly rotated, is grounded and has a negative bias potential; and, when the positive potential toner remaining adhered to the transferring belt 31 is contacted with the cleaning roller 37 and passed through the roller, the toner is adhered and transferred to the cleaning roller 37, and cleaned. The toner adhered and transferred to the cleaning roller 37 is scraped off by the elastic cleaning blade 37*a* which is made of PET or rubber, and slidingly contacted with the cleaning roller 37.

It is expected that the cleaning means of the present invention can sufficiently conduct the cleaning operation by a couple of cleaning rollers. That is, when the toner which has not been adhered and transferred to the cleaning roller 37, and remains on the transferring belt 31, passes through the cleaning roller 37 section, the toner has a negative charge. Therefore, when the foregoing cleaning processes are repeated by a plurality of times, a cleaning operation can be sufficiently carried out. When the cleaning means structured as above is used, the belt is scarcely worn, and the durability of the cleaning means is superior, so that superior cleaning properties can be maintained for a long period of time.

In the image recording apparatus using the belt type of transferring device, when jamming is caused just before transfer, and thereby, there is no recording sheet P at the nip portion N at the time of transfer, a large amount of toner is adhered to the transferring belt 31. In this case, it is not sufficient for the transferring belt 31 to pass through the cleaning means only once, that is, the transferring belt 31 can not be sufficiently cleaned. Accordingly, when such jamming is caused, the transferring belt 31 is completely cleaned by the following operations. A program for jamming is previously prepared; the transferring belt 31 passes through the cleaning roller 38 and cleaning roller 37 portions, upon which a bias voltage is impressed and for which the switch S(38) and switch S(33) are tuned ON, by a plurality of times by a recovery operation; and when the cleaning operation is repeatedly conducted because only a one time operation is insufficient, the transferring belt can be completely cleaned.

Figure 5:
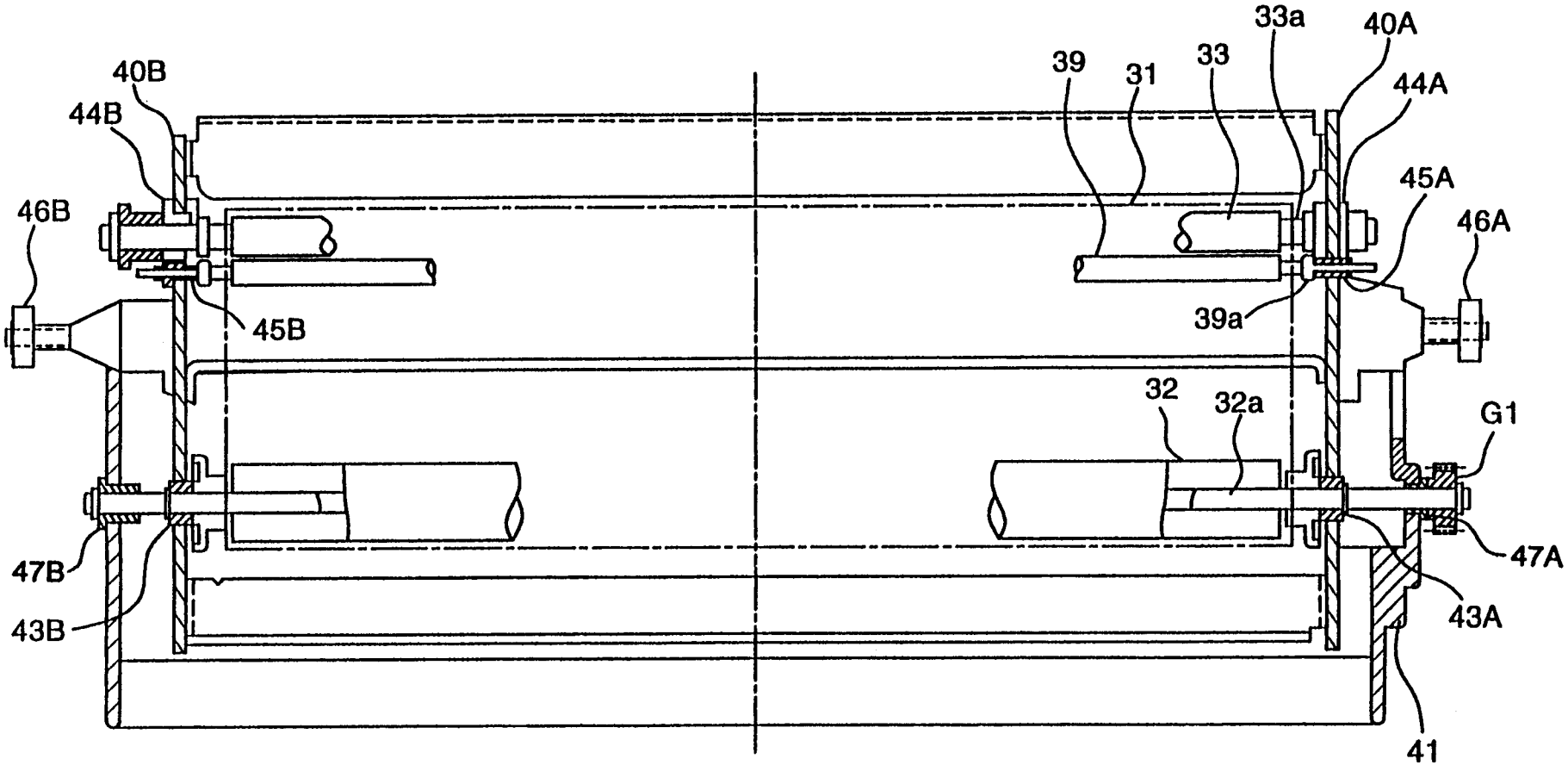
FIG. 5 is a plan view of the transferring belt device.
Figure 6:
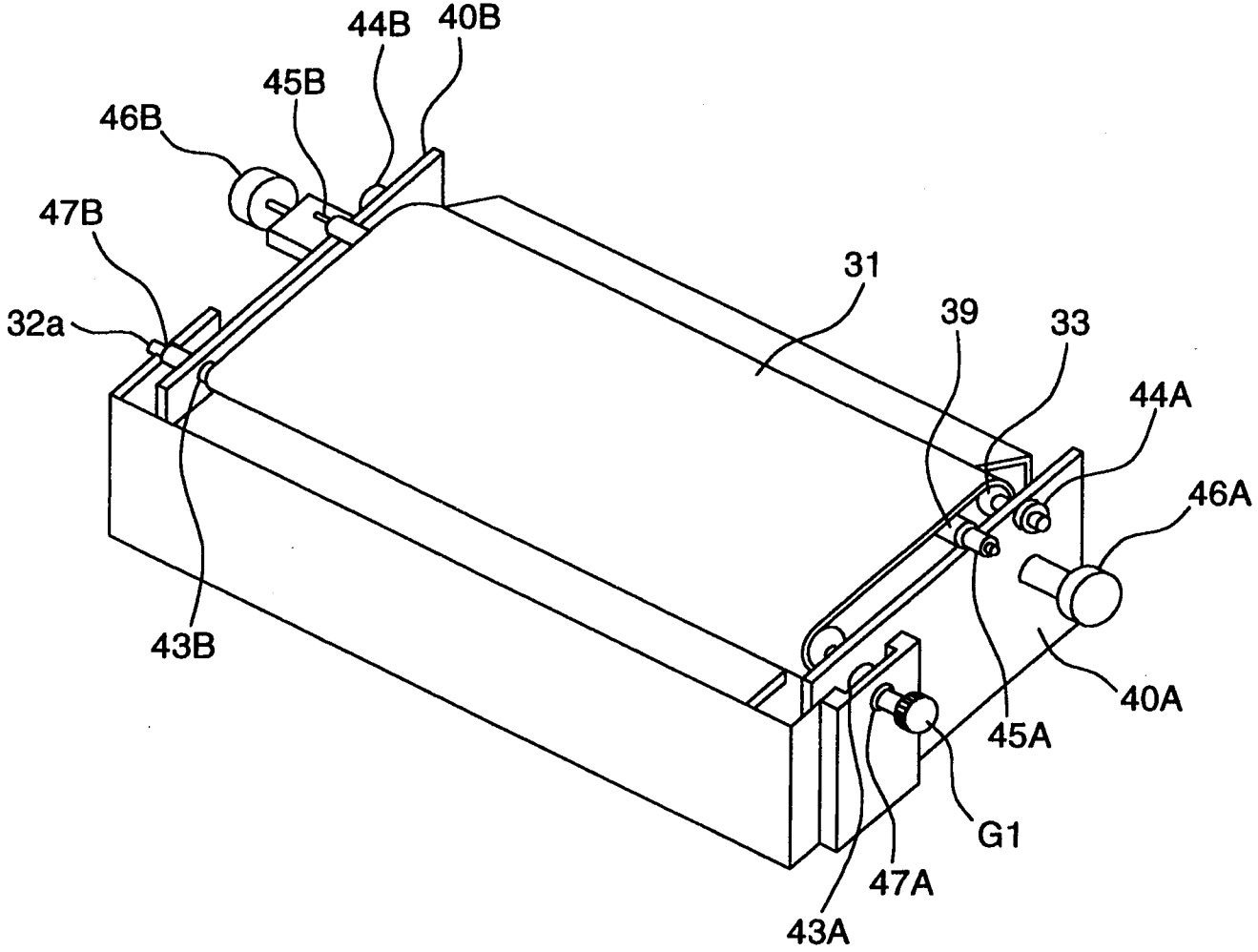
FIG. 6 is a perspective view of the transferring belt device.

FIG. 5 is a plan view of the transferring belt device of the present invention, and FIG. 6 is a perspective view of the transferring belt device.

Bearings 43A, 43B by which both ends of the rotation shaft 32*a* of the driving roller 32 are rotatably supported, bearing member 44A, 44B in which one-way spring clutches are accommodated, and by which both ends of the rotation shaft 33*a* of the driven roller 33 are supported, bearings 45A, 45B by which both ends of the shaft of the spacing roller 39 are rotatably supported, bearings (not shown) by which both ends of the shaft of the tension roller 35 are rotatably supported, and bearings (not shown) for cleaning rollers 37, 38 are provided in side plates 40A, 40B which are respectively provided in the front and rear portions of the movable frame 40. The bearings are accurately provided so that rollers can be in parallel with each other.

A gear G1 fixed to one end of the rotation shaft 32*a* of the driving roller 32 is connected with a driving source (not shown in the drawings) to transmit the driving force.

Roller-shaped cam followers 46A, 46B, which are contacted with a cam (not shown in the drawings) with pressure which are rotated by a driving source of the image recording apparatus main body so that the movable frame 40 is moved up and down, are fixed to the side plates 40A and 40B.

One end portion of the rotation shaft 32*a* of the driving roller 32 provided in the movable frame 40 is inserted into and supported by a stationary bearing 47A fixed to one side wall of a housing 41 fixedly provided in the image recording apparatus main body. The other end portion of the rotation shaft 32*a* is inserted into and supported by a movable bearing 47B which slidably moves in a linear slot provided in the other side wall of the housing 41.

Both end portions of the rotation shaft 32*a* of the driving roller 32 are respectively supported by the stationary bearing 47A and the movable bearing 47B provided in both side walls of the housing 41. The movable frame 40 which rotates the transferring belt 31 while holding the rollers 32, 33, 35, 37, 38, 39, is upwardly urged by the pressing spring 42.

When cam followers 46A, 46B are contacted with the cam portion by the cam rotation in the case of toner image transferring, the movable frame 40 is urged around the rotation shaft 32*a* by the spring and moved upward. When the movable frame 40 is moved near the uppermost portion of its movement, the cam followers 46A, 46B are separated from the cam surface, and when the movable frame 40 is moved to the uppermost portion, the spacing roller 39 is closely contacted with the peripheral surface of the photosensitive drum 10 with pressure by the spring through the transferring belt 31. Even when the spacing roller 39 and the driving roller 32 are not in parallel with each other, the transferring belt 31 around these rollers can be moved as follows. The movable bearing 47B, by which the other end portion of the driving shaft 32*a*, which is not used for drive, of the driving roller 32 is supported, can be slidably moved in a slot of the side wall of the housing 41, is not restrained, and is maintained to be free, and therefore, the transferring belt 31 can be smoothly moved under the condition that the spacing roller 39 is closely contacted with the photosensitive drum 10 with pressure, and can not be moved in a zigzag direction, or can not be skewed.

Figure 7:
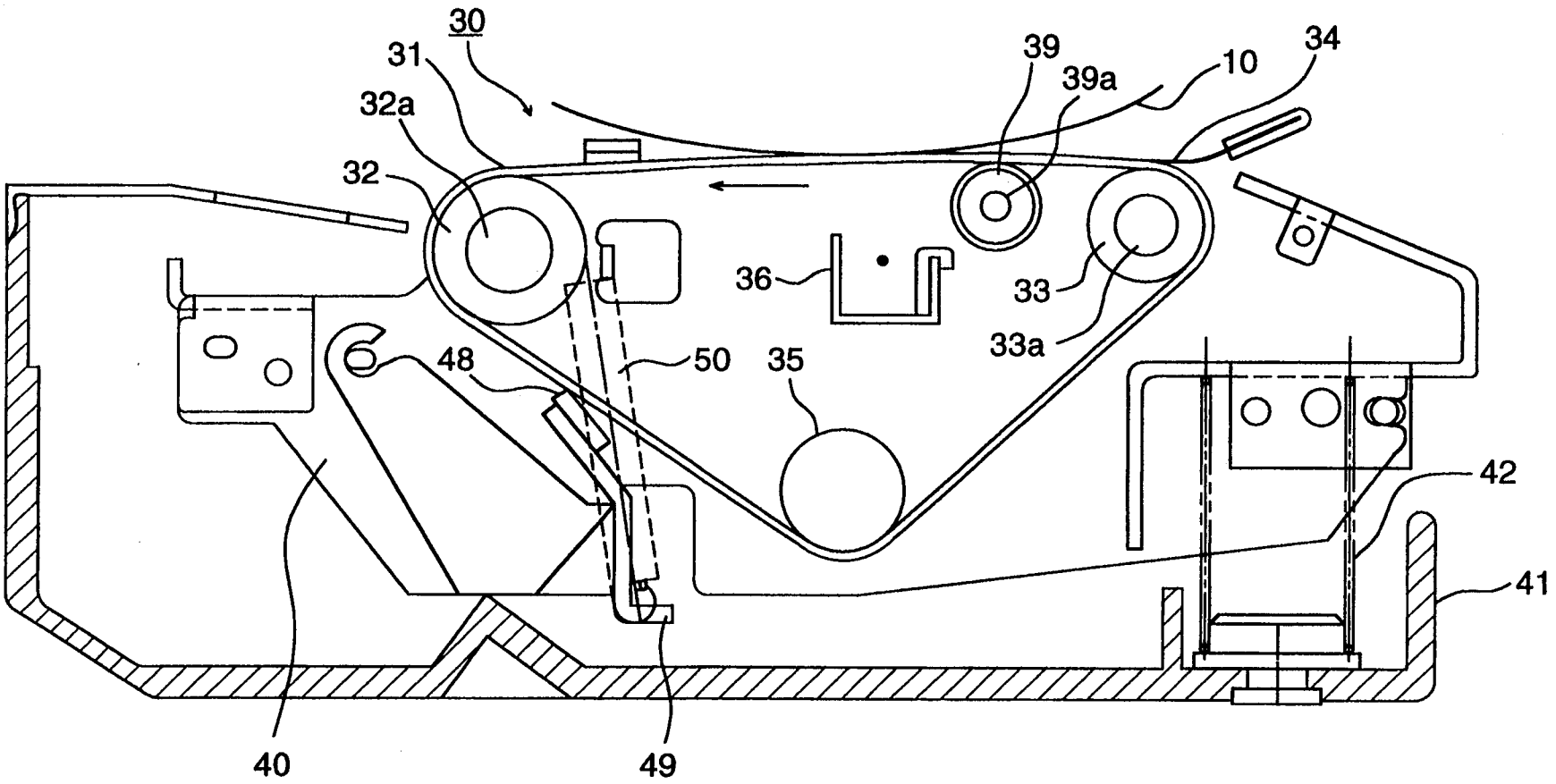
FIG. 7 is a schematic view showing the structure of the transferring device of another example of the present invention.

FIG. 7 is a schematic view showing another example of the transferring belt device according to the present invention. In the drawing, the same number is given to parts having the same function as those in the foregoing example. Different portions from the foregoing example will be described as follows.

In the transferring belt device of this example, the cleaning blade 48 is provided instead of the cleaning rollers 37 and 38. The cleaning blade 48 is stuck on an oscillating support plate 49 urged by a tension spring 50, and an end of the elastic blade 48 is contacted with the outer peripheral surface of the transferring belt 31.

Also in the transferring belt device 30 having such a cleaning means, when one end portion of the shaft of the driving roller 32 in the present invention is supported to be free, the transferring belt 31 can be stably moved.

Two examples have been explained above. The supporting means of the rotation shaft of the driving roller of the transferring belt device is not limited to that in the foregoing examples, but other supporting means may be used.

According to the present invention, an image recording apparatus with the transferring belt device characterized by the following advantages can be provided: precise machining and a exact adjustment, by which parallel positions of the driving roller and the spacing roller around which the transferring belt is wound are maintained, are not necessary; superior transfer properties can be always obtained; faults or noises caused by discharge in the transferring portion are not generated; and a highly reliable transfer image can be obtained.

Further, vibrations of the transferring belt, uneven pitch, or the skewed movement of the belt can be solved by the transferring belt device, and the transferring belt can be stably rotated, so that a superior image transfer can be accomplished.

Figure 8:
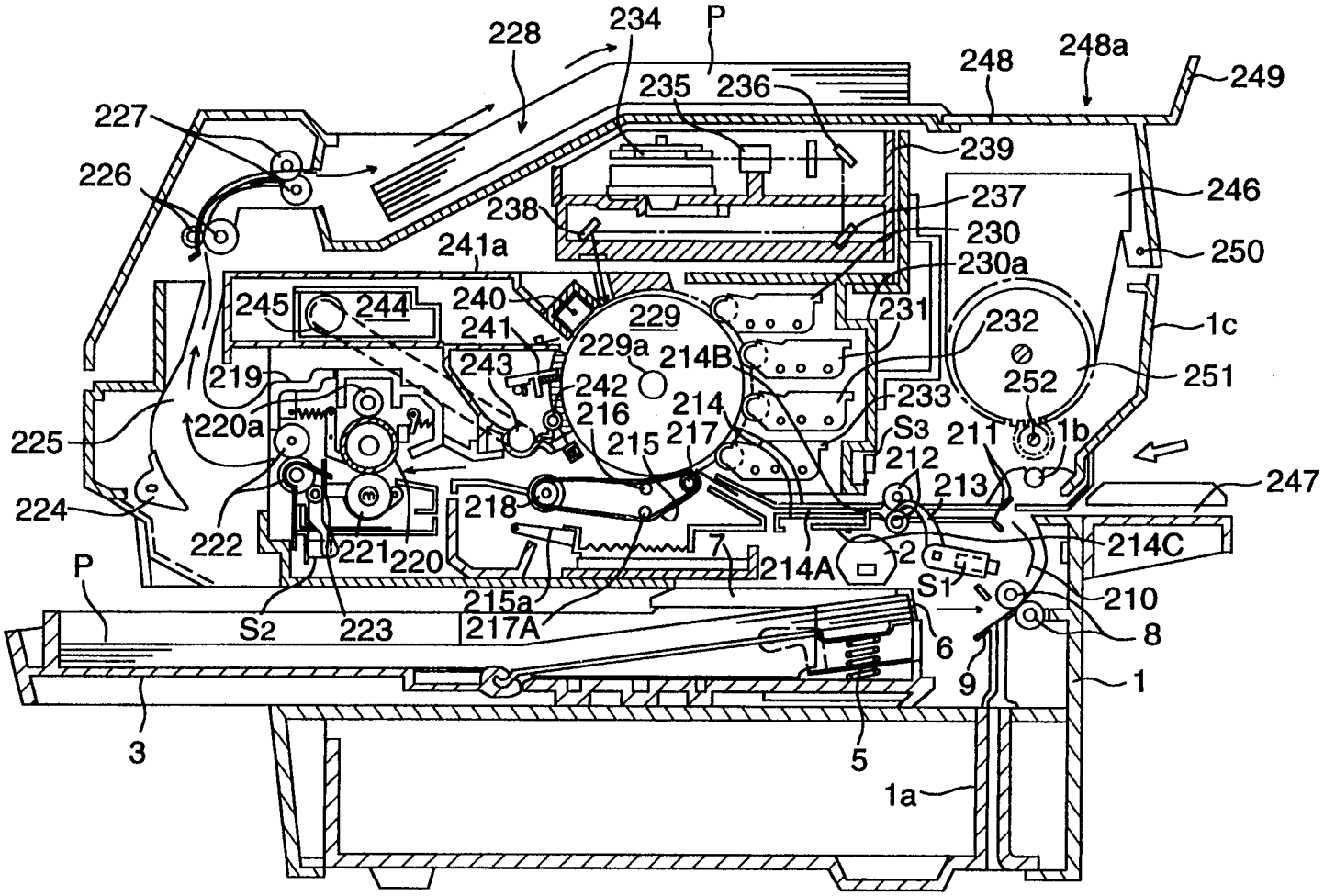
FIG. 8 is a schematic view showing the entire structure of an image forming apparatus of another example of the present invention.

In FIG. 8, numeral 1 is a lower frame of the image forming apparatus, in which a semi-circular sheet feeding roller 2, by which the recording sheet P is fed, is provided, and a sheet feeding cassette 3, in which a plurality of recording sheets P are accommodated, is detachably provided in the lower frame 1. A plate 4 which is pushed upward by a spring 5 is provided in the sheet feeding cassette 3, and the recording sheets P are stacked on the plate 4. A separation claw 6 rotatably provided to a portion of the sheet feeding cassette 3 is contacted with a leading edge of the uppermost recording sheet P. Numeral 7 are guide plates by which both sides of the recording sheet P are guided, and which are provided so that an interval between the two plates can be adjusted according to the size of the recording sheet. The above-described structures are provided in the sheet feeding cassette 3. Numeral 8 is a second recording sheet feeding roller provided in the lower frame 1, and provided between a guide plate 9, by which the leading edge of the recording sheet P fed by the sheet feeding roller 2 is guided, and a reversal guide plate 210.

Numeral 211 is a guide plate by which the recording sheet P is guided to a third sheet feeding roller 212 after the recording sheet P is reversely fed. Numeral 213 is an induction member by which a detection means S1 to detect the recording sheet P at the position of the third sheet feeding roller 212, is turned ON, or OFF. Numeral 214 is a guide plate by which the recording sheet P which has passed through the third sheet feeding roller 212 is guided to the direction of a transferring belt 215, and a stopper 214C having a protrusion 214B protruded to a sheet feeding path 214A is provided at a portion of the guide plate 214. The transferring belt 215 is wound around a transferring roller 216, rollers 217, 217A and a driving roller 218. Numeral **215*a* is a cleaning means by which the surface of the transferring belt 215 is cleaned. Numeral 219 is a fixing device by which an image transferred onto the recording sheet P is fixed, and which is composed of a thermal-fixing roller 221 and a pressing roller 220. A cleaning roller 220*a* is contacted with the pressing roller 220, and cleans it corresponding to the rotation. Numeral 222 is a delivery roller by which the recording sheet P is delivered from the fixing device 219. When the recording sheet P is delivered from the fixing device 219, an oscillating member 223, by which a sensor S2 is turned ON or OFF in order to confirm the delivery of the recording sheet P, is operated by the recording sheet P. The recording sheet P is delivered by a recording sheet guide member 224, a sheet guide path 225 formed in the upper frame 1*c*, and sheet guide rollers 226 and 227 onto a delivery sheet tray 228 provided in the upper portion of an upper frame 1*c*. Numeral 248 is a tray provided on a extended portion of the delivery sheet tray 228. The tray 248 is provided in the upper frame 1*c* and supported by the shaft 250, and provided with a stopper portion 249 and a delivery sheet tray surface 248*a***.

Next, a photosensitive drum 229 for image formation is provided in an almost central portion of the upper frame **1*c*. A developing device frame 230*a* in which four developing devices 230, 231, 232, 233 are respectively provided from the upper portion to the lower portion is provided around the surface of the photosensitive drum-229. Gears (not shown in the drawing) by which the four developing devices, in which yellow, magenta, cyan, and black developers of three primary colors are respectively loaded, are independently operated respectively using driving-switching means are provided in the developing device frame 230*a* as shown in FIG. 8. Numeral 234 is a polygonal mirror, and a laser beam emitted from a laser light source 235 is reflected by reflection mirrors 236, 237, 238 to expose the photosensitive drum 229. Numeral 239 is an optical system frame in which an optical system composed of the polygonal mirror 234, and reflection mirrors 236, 237, 238 is integrally accommodated, and which is housed in the uppermost portion of the upper frame 1*c***.

Numeral 240 is a charging electrode by which the entire surface of the photosensitive drum 229 is charged, and which is provided in a portion of the upper frame **1*c*. Numeral 241 is a cleaning blade by which remaining toner adhered to the photosensitive drum 229 surface after the image has been transferred from the photosensitive drum onto the recording sheet P is cleaned. A conveying device 243, by which the toner cleaned by the cleaning blade is received and delivered outside the cleaning device, is provided near the cleaning blade, and a toner receiving member 242, by which the toner scraped off by the cleaning blade is efficiently sent to the conveying device 243, is provided under the cleaning blade 241. The system is structured in the following manner: the toner conveyed outside the cleaning device by the conveying device 243 is conveyed to a vessel 244 by a conveyer 245; the toner can be accumulated in the vessel 244 to an appropriate amount; and the vessel 244 can be removed from the apparatus so that it can be discarded. Numeral 246 is a toner container by which toners are respectively supplied to developing devices 230, 231, 232, 233, and although the toner container shown in the drawing is only one, four toner containers are provided in parallel with each other. Cyan, magenta, yellow, and black toners are respectively supplied from the four toner containers to developing devices 230, 231, 232, and 233 so that color development can be carried out. Numeral 251 is a toner supply gear provided in the toner container, and numeral 252 is its driving means. Numeral 247 is a manual feeder by which the recording sheet P can be supplied by manual feeding. The lower frame 1 and the upper frame 1*c* is structured so that the conveyance path of the recording sheet P can be opened around the support shaft 1*b*. Therefore, when sheet jamming is caused during the conveyance of the recording sheet P, and the recording sheet P can not reach the fixing device 219, the upper frame 1***c* is opened around the support shaft 1*b*, and the recording sheet P can be removed. The guide plate 1*a*, by which the recording sheet P can be supplied from other sheet feeding devices (not shown in the drawing) provided in the lower frame 1, is provided in the lower frame 1.

After the recording sheet P is fed by the sheet feeding roller 2, and conveyed by the second sheet feeding roller 8, the recording sheet P is stopped once at the stopper 214C provided near the third sheet feeding roller 212. Next, sheet feeding is started by the third sheet feeding roller 212 so that the recording sheet can coincide with the image formed on the photosensitive drum 229.

Figure 9:
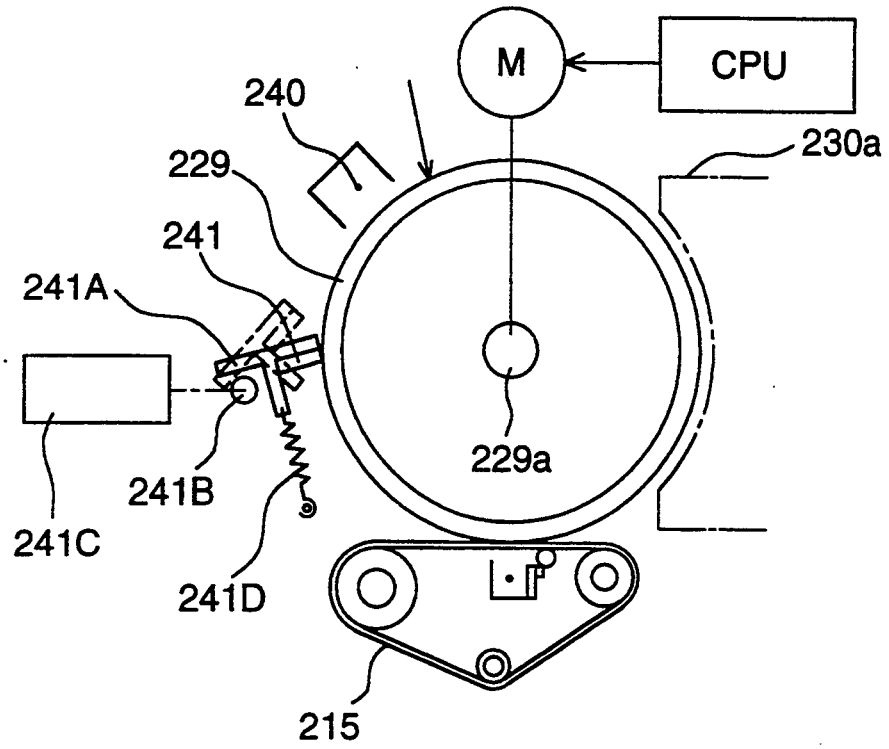
FIG. 9 is a view showing an operation mechanism of the photosensitive drum and a cleaning blade.

FIG. 9 is a view showing the structure of the transferring belt 215 and the cleaning blade 241 around the photosensitive drum 229. The system is structured as follows: the cleaning blade 241 is fixed to the base plate 241A; the base plate 241A is fixed to the rotation shaft 241B; the rotation shaft 241B is moved together with the solenoid 241C; and the cleaning blade 241 is released from the surface of the photosensitive drum 229 by the solenoid 241C. Numeral 241D is a spring provided on the base plate 241A by which the cleaning blade 241 is contacted with the photosensitive drum surface 229 with pressure.

The present invention is structured as described above. The laser beam is emitted from the laser light source 235, the emission of which is controlled by an image signal inputted from the outside of the apparatus. The photosensitive drum 229 charged by the charging electrode 240 is exposed by the laser beam with the polygonal mirror through reflection mirrors 236, 237, and 238. The latent image formed by the exposure on the photosensitive drum surface is developed by the developing devices 230, 231, 232, 233 in which yellow, magenta, cyan and black toners are respectively contained when the photosensitive drum 229 is rotated a plurality of times and color toners are successively superimposed on the drum surface, so that a color toner image can be formed on the photosensitive drum surface 229. In order to transfer the color image onto the recording sheet P, sheet feeding of the recording sheet P in the sheet feeding cassette 3 is started by the sheet feeding roller 2; the recording sheet P is fed to the third sheet feeding roller 212 through the second sheet feeding roller 8; and the recording sheet P is fed to the transfer section when accurate positioning is carried out by the protrusion 214B provided between the sheet feeding roller 212 and the transferring belt 215 so that the portion, at which the color toner image is formed on the photosensitive drum 229, can coincide with the recording sheet P. The recording sheet P onto which the color toner image is transferred is fed between the fixing thermal roller 221 and the pressing roller 220, and is thermally fixed. After that, the recording sheet P is delivered onto the delivery tray 228. As described above, the color toner image is transferred onto and fixed on the recording sheet P.

Figure 10:
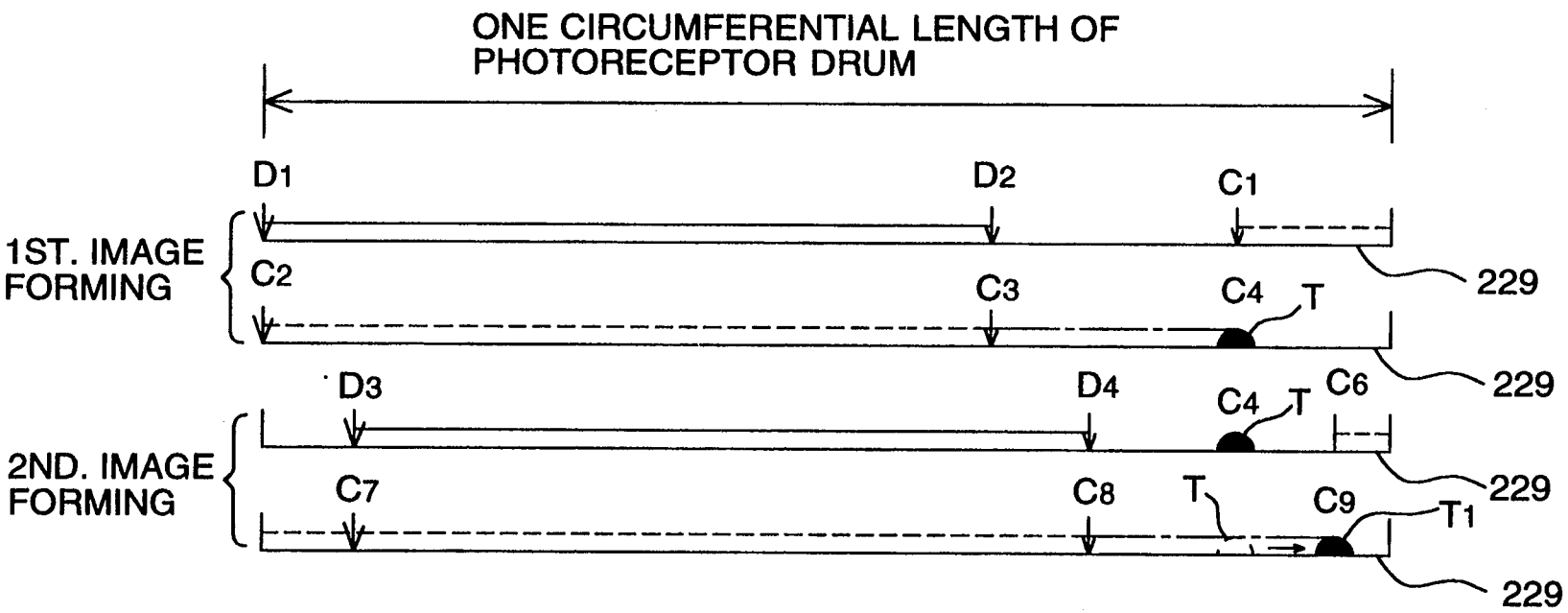
FIG. 10 is an illustration when pressure contact of the cleaning blade with the surface of the photosensitive drum is released.

The photosensitive drum 229 by which the image transfer operation has been completed, is cleaned by the cleaning blade 241. The cleaning operation is carried out by the operation shown in FIG. 10. For easy understanding, one circumferential length of the photosensitive drum surface 229 is shown horizontally in FIG. 10.

In the drawing, the first image formation is carried out from $D_1$ to $D_2$ by the developing device. At the time, four image formations are successively carried out by each color toner on the photosensitive drum 229 surface because four color toners are used for development by developing devices 230, 231, 232, 233. During the foregoing time, the cleaning blade 241 is separated from the photosensitive drum 229 surface by the solenoid 241C. Finally, exposure is conducted on only the portion on which the toner image has been formed, by the laser not shown in the drawing, after that, the color image is transferred onto the recording sheet P by the transferring belt 215. Before the foregoing operations have been completed, and the photosensitive drum 229 surface, onto which the transfer operation has been completed, reaches the position of the cleaning blade 241, the solenoid 241C is turned off, and the cleaning blade is contacted with the photosensitive drum 229 surface with pressure by the spring 241D. That is, the cleaning operation starts from point $C_1$ shown in FIG. 10. The image forming surface corresponds to the surface from $C_2$ to $C_3$ on the photosensitive drum 229 surface, and the remaining toner on the surface is cleaned by the edge of the cleaning blade 241. Further, the photosensitive drum surface is cleaned to point $C_4$ through the point $C_3$, and the edge of the cleaning blade 241 is separated from the photosensitive drum 229 surface by the solenoid 241C. Accordingly, a small amount of the toner cleaned by the cleaning blade 241 adheres to and remains on the point $C_4$ in the shape of a ridge as shown by T in the drawing.

That is, as shown in FIG. 9, the cleaning operation is conducted on one turn of the peripheral surface of the photosensitive drum 229. A motor M shown in FIG. 9 is controlled by a CPU provided in the image forming apparatus so that the motor M is synchronously moved with the shaft 229*a* of the photosensitive drum 229. Next, the image is formed by the second developing device from $D_3$ to $D_4$ shown in FIG. 10.

Four color development is conducted in the same way as the foregoing, and finally, exposure is conducted on only the portion on which the toner image has been formed. After that, the toner image is transferred onto the recording sheet P from the photosensitive drum 229 surface by the transferring belt 215. Next, the edge of the cleaning blade 241 is contacted at point $C_6$ with pressure by the spring 241D in the same way as the foregoing, and cleans the remaining toner on the area from point $C_7$ to point $C_8$ on which the image has been formed. Further, a small amount of the remaining toner T remaining at point $C_4$ at the first cleaning, is moved to point $C_9$ by the edge of the cleaning blade 241, and adheres to the point as remaining toner $T_1$. Next, the cleaning blade 241 is separated from the photosensitive drum 229 surface by the solenoid 241C. In the manner described above, also after the third cleaning operation, the remaining toner T is successively moved on the photosensitive drum 229 surface, and therefore, a plurality of ridges of toner T are not generated on the photosensitive drum surface.

As described above, especially, in an image forming apparatus in which development is conducted using four color toners, the present invention has the following advantages. After the photosensitive drum has been cleaned by a cleaning blade, and the cleaning blade has been separated from the photosensitive drum 229 surface, generation of ridges of a plurality of remaining toners slightly remaining on the photosensitive drum 229 surface is prevented so that only one ridge of the remaining toner remains on the surface. Therefore, entrance of the remaining toner into a developing device is greatly reduced, and thereby, the color tone of the color toner can be satisfactorily maintained. Further, transition of the remaining toner onto the transferring belt can be prevented, so that occurrence of stains on the recording sheet due to the toner can be desirably prevented.

What is claimed is:

1. An image recording apparatus comprising:

(a) a rotating photoreceptor drum on which a toner image is formed;

(b) a transfer belt charged by a corona charger disposed on a rear side of said transfer belt, said transfer belt transferring said toner image onto a recording sheet and conveying said recording sheet;

(c) a driving roller for driving said transfer belt, said driving roller having first and second end portions and rotational shaft portions positioned at said first and second end portions thereof, one of said rotational shaft portions being connected with a driving source for driving said driving roller;

(d) a driven roller having first and second end portions, said driven roller being driven by said driving roller as said driving roller drives said transfer belt, said driven roller having rotational shaft portions provided at said first end second end portions thereof;

(e) a frame for supporting said rotational shaft portions of both said driving roller and said driven roller, such that said transfer belt is stretched in a loop around both said driving roller and said driven roller; and (f) a stationary housing for rotatably supporting said frame about a plurality of bearings and for supporting said rotational shaft portions of said driving roller, wherein a first one of said plurality of bearings is fixedly provided to said stationary housing to support that one of said rotational shaft portions of said driving roller which is connected with said driving source, a second one of said plurality of bearings is movably provided relative to said stationary housing, said second one of said plurality of bearing supporting the other one of said rotational shaft portions of said driving roller.

2. The image recording apparatus of claim 1, wherein said transfer belt contacts with said rotating photoreceptor drum.

3. The image recording apparatus of claim 2, wherein the second one of said plurality of bearings is movable in a direction that is substantially perpendicular to a conveying direction of a part of said transfer belt that is located in an upstream direction upstream of said driving roller and in a downstream direction downstream of another portion of said transfer belt where said transfer belt contacts with said rotating photoreceptor drum.

4. The image recording apparatus of claim 2, further comprising:

a spacing roller for maintaining a distance between said photoreceptor drum and said transfer belt, said spacing roller being positioned in an upstream direction, upstream of a contact position of said photoreceptor drum with said transfer belt.

5. The image recording apparatus of claim 4, wherein said spacing roller has a large diameter portion and a small diameter portion, said large diameter portion contacting said photoreceptor drum.

6. The image recording apparatus of claim 5, wherein said small diameter portion of said spacing roller contacts said transfer belt.

* * * * *